United States Patent [19]

McCanney

[11] 4,241,235

[45] Dec. 23, 1980

[54] VOICE MODIFICATION SYSTEM

[75] Inventor: Neil R. McCanney, Norwalk, Conn.

[73] Assignee: Reflectone, Inc., Stamford, Conn.

[21] Appl. No.: 26,593

[22] Filed: Apr. 4, 1979

[51] Int. Cl.[3] ..... G10L 1/00

[52] U.S. Cl. ..... 179/1 SH; 179/15.55 T

[58] Field of Search ..... 179/1 SA, 15.55 T, 107 FD, 179/1 SH

[56] References Cited

U.S. PATENT DOCUMENTS

| | | | |
|---|---|---|---|
| 3,394,228 | 7/1968 | Flanagan et al. | 179/1 SH |
| 3,431,356 | 3/1969 | Copel | 179/15.55 R |
| 3,651,268 | 3/1972 | Riukin | 179/1.5 M |
| 3,991,271 | 11/1976 | Branscome et al. | 178/69.5 R |
| 4,020,285 | 4/1977 | Branscome et al. | 179/1.5 R |
| 4,024,535 | 5/1977 | Goldstein | 340/384 E |

OTHER PUBLICATIONS

R. Schroeder, et al. "Making Voices from the Depths sound Deeper," Bell Tel. Lab., 1967.

*Primary Examiner*—Felix D. Gruber
*Assistant Examiner*—E. S. Kemeny
*Attorney, Agent, or Firm*—Robert R. Jackson

[57] ABSTRACT

Human voice sounds are modified to produce the effect of a different person speaking. A signal representative of the original voice sounds is separated into a plurality of voice signal components each having a different frequency band. The frequency of at least one voice signal component is shifted and the voice signal components are recombined to produce a modified voice signal representative of the modified but intelligible voice sounds.

9 Claims, 8 Drawing Figures

VOICE MODIFICATION SYSTEM

The invention herein described was made in the course of or under Contract F 33657-76-C-0103 with the United States Air Force.

BACKGROUND OF THE INVENTION

This invention relates to methods and apparatus for modifying human voice sounds to produce other voice sounds which are intelligible but which do not sound like the original voice sounds.

In activities such as aircraft flight training simulations, the trainee hears, and must respond to, simulated radio communications from several sources, e.g., an airport controller, ground controllers at various locations, and other aircraft in his vicinity. In a real situation, each of these radio communications would have recognizably different sound characteristics, largely because of the different voice characteristics of the various speakers originating them. In a flight simulation, however, one speaker (i.e., the person controlling the simulation) generally originates with his own voice all of the simulated radio cummunications the trainee hears. The trainee therefore hears only one voice playing several different roles and an important element of realism is missing from the simulation.

It is therefore an object of this invention to provide methods and apparatus for modifying human voice sounds to produce other voice sounds which are intelligible but which are not recognizable as the original voice sounds.

In the flight training simulation situation described above, the object of the invention is to modify a normal human voice sound so that it sounds like one or more other normal human voice sounds. This application of the invention may be referred to for convenience as "normal voice in and modified normal voice out". There are, however, other applications of the invention in which either (1) the original voice sounds are not normal voice sounds and the invention is used to modify those sounds to produce more normal and more intelligible voice sounds, or (2) the original voice sounds are normal and the invention is used to modify those sounds to produce abnormal voice sounds which are still intelligible. An example of the first of the foregoing alternatives is modifying the voice sounds of a person such as an underwater diver whose voice sounds are distorted by breathing a combination of gases having density very different from the density of atmospheric air. Typically, the gases supplied to an underwater diver have a large constituent of helium in place of the nitrogen which makes up most of atmospheric air. The diver is therefore breathing a combination of gases which is much less dense than atmospheric air and the pitch of his voice is therefore raised to the point where his voice sounds are virtually unintelligible. This invention can be used to at least partially restore these voice sounds to normal pitch and greatly improve their intelligibility.

An example of the second alternative mentioned above is cartoon sound tracks in which it is desired to modify normal voice sounds to produce abnormal but still intelligible voice sounds for comic or similar effects.

In view of the foregoing, it is a further object of this invention to provide methods and apparatus for modifying distorted human voice sounds to produce voice sounds which are more normal and more intelligible.

It is another object of the invention to provide methods and apparatus for modifying normal human voice sounds to produce voice sounds which are abnormal but still intelligible.

SUMMARY OF THE INVENTION

The foregoing objects and other objects of the invention are accomplished in accordance with the methods of the invention by separating the voice sounds to be modified into a plurality of voice sound components each having a separate frequency band, shifting the frequency of at least one voice sound component, and recombining the voice sound components to produce the modified voice sounds. Apparatus constructed in accordance with the principles of the invention includes means for separating an input signal representative of the voice sounds to be modified into a plurality of voice signal components each having a different frequency band, means for shifting the frequency of at least one voice signal component, and means for combining the voice signal components to produce a signal representative of the modified voice sounds. The apparatus of the invention may include means for selectively controlling the frequency shift of one or more of the voice signal components so that one speaker can produce voice sounds characteristic of several speakers and/or so that the transfer characteristics of the apparatus can be varied to achieve various effects.

Further objects of the invention, its nature and various advantages will be more apparent from the accompanying drawing and the following detailed description of the invention.

DETAILED DESCRIPTION OF THE INVENTION

Figure 1:
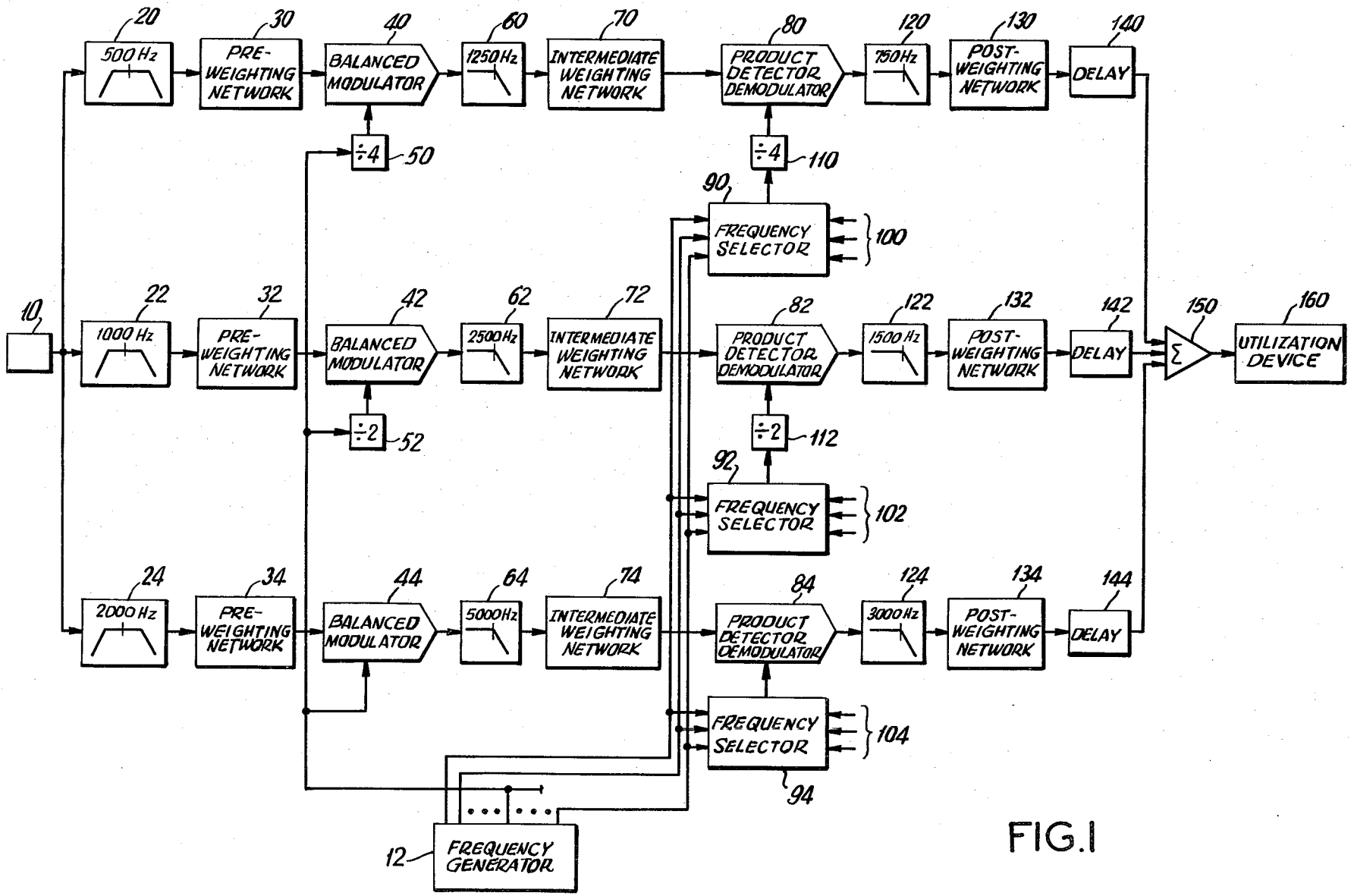
FIG. 1 is a block diagram of a preferred embodiment of the apparatus of the invention.

As shown in FIG. 1, the voice modification apparatus of this invention includes voice signal source 10 for producing an electrical signal representative of the voice sound to be modified. Voice signal source 10 may be a microphone or a coupling to any source of live or recorded voice sounds or voice sound signals.

Figure 2:
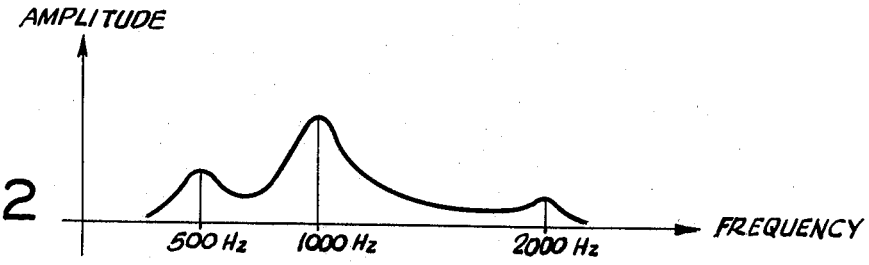
FIG. 2 is a diagram of an instantaneous voice signal frequency spectrum which is useful in explaining the principles of the invention.

The voice signal produced by voice signal source 10 will typically have a frequency spectrum at a particular instant of time like that shown in FIG. 2. Although this frequency spectrum will vary with time as the speaker forms different sounds to produce speech, the instantaneous frequency spectrum of FIG. 1 is typical and serves to illustrate the nature of voice sounds and voice sound signals. The voice sound frequency spectrum of FIG. 2 spans a frequency range from about 300 Hz to about 3000 Hz. Three frequency constituents of this spectrum (i.e., 500 Hz, 1000 Hz, and 2000 Hz) are emphasized for reference. A full fidelity frequency spectrum may span the full audio frequency band from about 16 Hz to about 20,000 Hz, but most of the energy will be present in the narrower frequency range mentioned above and that range (which corresponds to the frequency band of ordinary telephone transmission apparatus) is generally adequate for conveying intelligible speech.

Referring again to FIG. 1, the voice signal produced by voice signal source 10 is applied to each of a plurality of band pass filters 20, 22, 24. Each of band pass filters 20, 22, 24 has a unique frequency pass band. The pass bands of filters 20, 22, 24 are preferably substantially mutually exclusive, i.e., there is preferably little or no overlap between the pass bands of these filters. The pass bands of filters 20, 22, 24 preferably also span the frequency band of the original voice signal, i.e., the pass bands of these filters are preferably substantially collectively exhaustive of the original voice signal frequency band. The center frequencies of the pass bands of filters 20, 22, 24 are also conveniently octavely related, i.e., the center frequency of the pass band of each filter is conveniently approximately twice the center frequency of the next lowest frequency pass band and approximately half the center frequency of the next highest frequency pass band. As will be more apparent hereinafter, this octave relationship between the pass bands of filters 20, 22, 24 makes it possible to use one series of basic modulation and demodulation signal frequencies, with appropriate frequency division by convenient factors such as 2 or 4, for subsequent processing of the output signals of filters 20, 22, 24. From the foregoing it is apparent that filters 20, 22, 24 separate the applied voice signal into three voice signal components each having a different frequency range corresponding to the pass band of the associated filter.

In the particular embodiment shown in FIG. 1, the pass band characteristics of filters 20, 22, 24 may be as follows:

| | Lower Roll-Off Frequency | Center Frequency | Upper Roll-Off Frequency |
|---|---|---|---|
| Filter 20 | 350 Hz | 500 Hz | 650 Hz |
| Filter 22 | 700 Hz | 1000 Hz | 1300 Hz |
| Filter 24 | 1400 Hz | 2000 Hz | 2600 Hz |

The roll-off frequencies referred to above are the frequencies at which the frequency response of the filters begin to decline sharply as illustrated by the knees in the frequency response curves in the associated blocks in FIG. 1. The overall frequency band of the apparatus of FIG. 1 is approximately 300–3000 Hz which corresponds to the frequency band of the typical frequency spectrum shown in FIG. 2. If desired, higher fidelity voice modification can be achieved by increasing the number of channels, and especially by including additional channels at higher frequencies within the audio range of 16–20,000 Hz.

The voice signal component produced by each of filters 20, 22, 24 is applied to a respective one of preweighting networks 30, 32, 34 and then to a respective one of balanced modulators 40, 42, 44. Preweighting networks 30, 32, 34 adjust the amplitude of the applied voice signal component for more efficient operation of the associated balanced modulator (i.e., improved signal to noise ratio in the balanced modulator). Preweighting networks 30, 32, 34 may be adjustable if desired.

A preferably sinusoidal reference signal is also applied to each of balanced modulators 40, 42, 44 from frequency generator 12. Each of balanced modulators 40, 42, 44 modulates the applied reference signal with the applied voice signal component to produce an output voice component modulated signal. The reference signal frequency applied to each balanced modulator 40, 42, 44 is therefore substantially higher than the highest frequency in the voice signal component applied to that balanced modulator. In addition, the frequencies of the reference signals applied to balanced modulators 40, 42, 44 are conveniently octavely related to each other so that the ratio between each reference signal frequency and the center frequency of the associated band pass filter 20, 22, or 24 is the same for all channels of the apparatus. In the particular embodiment shown in FIG. 1 the basic reference signal frequency produced by frequency generator 12 is 5917.15 Hz and a reference signal having that frequency is applied to balanced modulator 44. A reference signal having one half this frequency is applied to balanced modulator 42 via frequency divider 52, and a reference signal having one fourth this frequency is applied to balanced modulator 40 via frequency divider 50. Because the center frequencies of the band pass filters are preferably octavely related, a single basic reference frequency signal can be used with appropriate frequency division by convenient factors such as 2 or 4 to produce reference signals for each channel of the apparatus such that the ratio between the reference signal and the center frequency of the associated voice signal component is the same for all channels.

Figure 4:
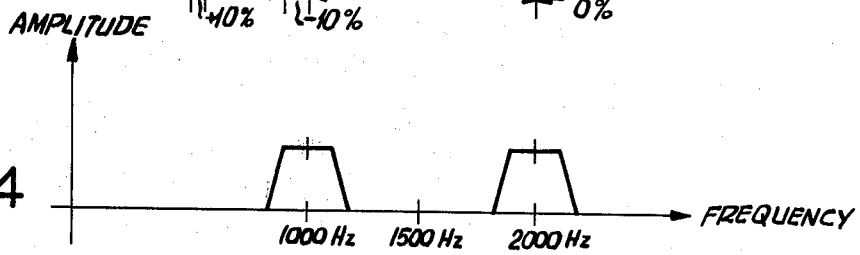
FIGS. 4–7 are diagrams showing signal component envelopes at various points in the apparatus of FIG. 1 and which are useful in explaining the operation of that apparatus.

The voice component modulated signals produced by balanced modulators 40, 42, 44 each includes two sidebands located symmetrically in the frequency domain about the associated reference signal frequency, the center of each sideband being spaced from the associated reference signal frequency by the base band center frequency of the associated voice signal component. For example, assuming for simplicity that the basic reference signal frequency is 6000 Hz rather than 5917.15 Hz as mentioned above, the two sidebands of the voice component modulated signal produced by balanced modulator 40 can be represented in the frequency domain as shown in FIG. 4. These two sidebands are located symmetrically about the associated reference signal frequency (assumed to be 6000 Hz divided by 4 or 1500 Hz) and the center of each sideband is spaced from this reference signal frequency by the base band center frequency of the associated voice signal component (i.e., 500 Hz for associated band pass filter 20). Thus the center frequencies of the two sidebands shown in FIG. 4 are 1000 Hz and 2000 Hz, respectively. Still assuming a basic reference signal frequency of 6000 Hz, the center frequencies of the two sidebands of the output signal of balanced modulator 42 would be 2000 Hz and 4000 Hz, respectively, and the center frequencies of the two sidebands of the output signal of balanced modulator 44 would be 4000 Hz and 8000 Hz, respectively. Again, it will be noted that the center frequencies of the lower sidebands of the output signals of balanced modulators 40, 42, 44 are conveniently octavely related.

Figure 5:
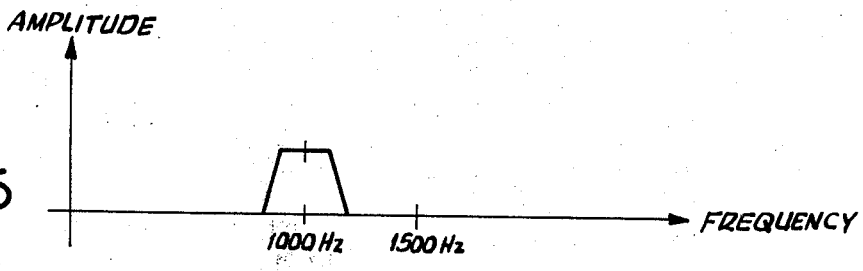

The voice component modulated signals produced by balanced modulators 40, 42, 44 are respectively applied to low pass filters 60, 62, 64 which substantially eliminate the upper sideband of each of those signals (see, for example, FIG. 5 which represents the output signal envelope of low pass filter 60 when FIG. 4 is assumed to represent the output signal envelope of balanced modulator 40). Each of low pass filters 60, 62, 64 therefore has a cutoff frequency between the sidebands of the applied signal. In the particular embodiment shown in FIG. 1, the cutoff frequencies of low pass filters 60, 62, 64 are preferably about 1250 Hz, 2500 Hz, and 5000 Hz, respectively. In an especially preferred embodiment, each of low pass filters 60, 62, 64 includes a low pass transversal filter having a cutoff frequency near the highest frequency in the lower frequency sideband of the applied signal followed by a less critical conventional low pass filter for attenuating the higher frequency noise produced by the transversal filter. If transversal filters are employed in this way, the clock signals for those filters are preferably derived from frequency generator 12 so that any frequency drift of frequency generator 12 causes compensating effects throughout the apparatus.

The output signals of low pass filters 60, 62, 64 are respectively applied to product detector demodulators 80, 82, 84 via intermediate weighting networks 70, 72, 74. Like preweighting networks 30, 32, 34 intermediate weighting networks 70, 72, 74 adjust the amplitude of the applied signal for more efficient operation of the associated product detector demodulator. Intermediate weighting networks 70, 72, 74 may be adjustable if desired.

Product detector demodulators 80, 82, 84 demodulate the voice component modulated signals respectively applied to them using periodic (e.g., sinusoidal or symmetrical square wave) demodulating signals also applied to them. Frequency generator 12 is also preferably the source of the demodulating signals applied to product detector demodulators 80, 82, 84. In addition to the basic reference frequency signal which is used either directly or after appropriate frequency division for the reference signals applied to balanced modulators 40, 42, 44, frequency generator 12 generates a plurality of other periodic signals each having a unique frequency different from the basic reference signal frequency. Typically, some of these frequencies are lower and some are higher than the basic reference signal frequency. One of these signals (possibly including the reference frequency signal) is selected for use either directly or after appropriate frequency division as the demodulating signal applied to each of product detectors 80, 82, 84. The same frequency generator output signal may be used as the source of all of the demodulating signals, or a different frequency generator output signal may be used as the source of each demodulating signal.

As in the case of the basic reference frequency signal, because the voice component modulated signals applied to demodulators 80, 82, 84 are preferably octavely related, each basic demodulating frequency signal produced by frequency generator 12 can be used with appropriate frequency division by convenient factors such as 2 or 4 to produce a demodulating signal for each channel such that the ratio between the center frequency of the voice component modulated signal in that channel and the associated demodulating signal frequency is the same for all channels. As will be more apparent hereinafter, this makes it possible by selection of a single basic demodulating signal to produce the same percentage shift in the frequency of each voice signal component relative to the initial frequency of that voice signal component. Moreover, each basic demodulating signal frequency produced by frequency generator 12 will cause a characteristic percentage shift in the frequency of the voice signal component processed using that basic demodulating signal (with frequency division as appropriate) regardless of the frequency of that voice signal component. This greatly simplifies and facilitates control of the apparatus, particularly where different effects are desired at different times.

In the particular embodiment shown in FIG. 1, selection of the frequency generator output signals (which are the basic demodulating frequency signals referred to above) to be used as the demodulating signals is accomplished by applying some or all of the frequency generator output signals (generally including the basic reference frequency signal) to each of frequency selectors 90, 92, 94. Each frequency selector, controlled by control signals applied to associated leads 100, 102, 104, selects one of the applied frequency generator output signals. Control signals 100, 102, 104 may be generated by any suitable control circuitry (not shown), e.g., manually operated switches or suitably programmed data processing apparatus. The frequency generator output signal selected by the frequency selector is used either directly or after appropriate frequency division as the demodulating signal for the associated product detector demodulator. The frequency generator output signal selected by frequency selector 94 is used directly as the demodulating signal applied to product detector demodulator 84. The frequency generator output signal selected by frequency selector 92 is applied to frequency divider 112 which produces an outut signal having half the frequency of the applied signal for use as the demodulating signal applied to demodulator 82. Similarly, the frequency generator output signal selected by frequency selector 90 is applied to frequency divider 110 which produces an output signal having one fourth the frequency of the applied signal for use as the demodulating signal applied to demodulator 80. Again, it will be noted that the frequency division factor applied to both the basic reference signal frequency and the selected basic demodulating signal frequency is the same for any given channel (e.g., both the basic reference signal frequency and the selected basic demodulating signal frequency are divided by four in the first channel by means of frequency dividers 50 and 110, respectively).

The demodulated voice component signals produced by product detector demodulators 80, 82, 84 each include a base band component located in the frequency domain below the demodulating frequency and displaced from the demodulating frequency by an amount equal to the frequency of the applied voice component modulated signal. In addition to the base band component, each demodulated voice component signal includes higher frequency components above the demodulating frequency. Assuming again, for example, that the reference signal applied to balanced modulator 40 is 1500 Hz and that the voice component modulated output signal of low pass filter 60 occupies the band represented in FIG. 5, and further assuming that the demodulating signal applied to demodulator 80 has frequency 1550 Hz (resulting from selection of a basic demodulating signal frequency of 6200 Hz), the output signal of demodulator 80 will include the components shown in FIG. 6, with the addition of other still higher frequency, lower amplitude components. In particular, the base band component of this signal has a center frequency of 550 Hz which is the demodulating signal frequency (1550 Hz) minus the center frequency (1000 Hz) of the voice component modulated signal applied to demodulator 80. Comparing this base band component to the original voice signal component applied to modulator 30 (as represented by the pass band of filter 20), it will be noted that the base band component of the demodulated signal is shifted in frequency by an amount equal to the difference between the reference and demodulating signal frequencies (i.e., 50 Hz). This is approximately a 10% shift in the frequency of this voice signal component relative to its initial frequency, it being understood that this percentage is calculated on the basis of the shift in the center frequency of the voice signal component and that, because of the constant shift in frequency (i.e., 50 Hz) experienced by all frequency constituents of the voice signal component, the percentage shift for frequency constituents below the center frequency is somewhat higher than 10% while the percentage shift for frequency constituents above the center frequency is somewhat lower than 10%.

The same general principles described above apply to each of the other channels of the apparatus. Thus (considering only the base band component of the demodulated signals) each voice signal component is shifted up or down in frequency or pitch by approximately the same amount that the demodulating frequency used to process that voice signal component is shifted up or down relative to the associated reference signal frequency. As pointed out above, because the voice signal components are octavely related and because the basic reference signal frequency and the basic demodulating signal frequencies are divided by factors which are octavely related in the inverse order to produce the reference and demodulating signal frequencies used to process the voice signal components, the difference between the basic reference signal frequency and the basic demodulating signal selected for use in processing each voice signal component is effectively divided by the frequency division factor associated with that voice signal component (i.e., factors of 4, 2, and 1 for the channels respectively including demodulators 80, 82, 84). Thus if the same basic 6200 Hz demodulating signal frequency which produced the above-described 50 Hz shift in the voice signal component processed in the channel including demodulator 80 is also selected for the remaining two channels, the base band component of the demodulated signal produced by demodulator 82 will be shifted 100 Hz (i.e., 3100 Hz minus 3000 Hz) and the base band component of the demodulated signal produced by demodulator 84 will be shifted 200 Hz (i.e., 6200 Hz minus 6000 Hz). Although the absolute amount of frequency shift for each channel is different, the percentage frequency shift is the same for all channels, i.e., approximately 10%. As mentioned elsewhere, it is of course not necessary that the same basic demodulating signal frequency be selected for all channels. Thus different basic demodulating signal frequencies may be selected for the several channels to produce different percentage frequency shifts in the several voice component signals. Other than these shifts in frequency, the voice signal component is substantially unaltered by the apparatus. Thus although the pitch of the voice component signal is changed, the rate of speech is not changed.

Figure 6:
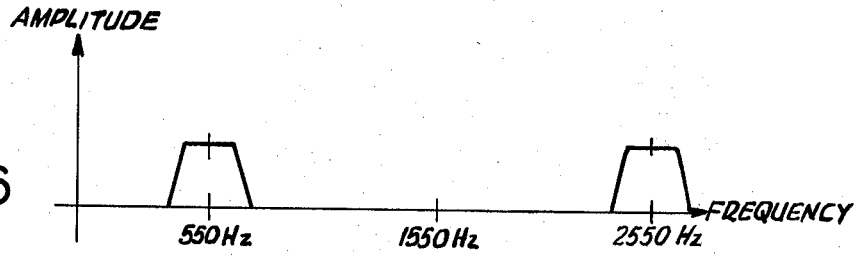
Figure 7:
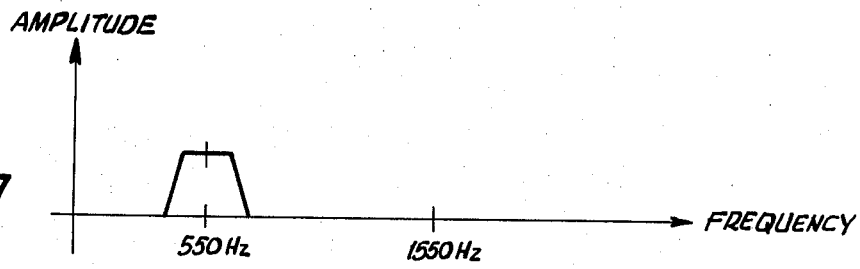

The output signals of product detector demodulators 80, 82, 84 are respectively applied to low pass filters 120, 122, 124, each of which substantially eliminates all but the base band component of the applied signal. Thus if the signal envelope applied to low pass filter 120 were as generally shown in FIG. 6, the output signal envelope of that filter would be as shown in FIG. 7. The cutoff frequencies of low pass filters 120, 122, 124 are therefore between the highest frequency anticipated for the base band component of the applied signal but lower than the lowest frequency anticipated for the unwanted higher frequency components of that signal. In the particular embodiment shown in FIG. 1 the cutoff frequencies of low pass filters are preferably about 750 Hz, 1500 Hz, and 3000 Hz, respectively.

The output signals of low pass filters 120, 122, 124 are respectively applied to postweighting networks 130, 132, 134. In general, these postweighting networks restore the original amplitude of the voice signal components. Post-weighting networks 130, 132, 134 may be adjustable and may additionally be used for changing the amplitude level of one or more voice signal components to provide some additional voice modification if desired.

The output signals of postweighting networks 130, 132, 134 are respectively applied to signal delay networks 140, 142, 144. These delay networks are provided to equalize the processing times of the signal channels so that the voice signal components are synchronized when they are recombined as described below. If the processing times of the signal channels are equal, delay networks 140, 142, 144 can be omitted. Delay networks may be required if transversal filters are included in low pass filters 60, 62, 64 as described above. Even if delay networks are required, the delay between the input voice signal and the modified output voice signal will not be substantial so that the apparatus can be used as a real-time signal processing device.

The output signals of delay networks 140, 142, 144 are finally applied to signal summing network 150 where they are recombined to produce a modified voice signal. This modified voice signal is applied to utilization device 160 which may be an audio transducer such as a speaker or headset, a recording device, or any similar acoustic device.

When the modified voice signal produced by the apparatus is rendered audible (e.g., by utilization device 160), the sound will be an intelligible voice sound. The modification of the voice sound is the result of shifting the frequency of one or more of the voice signal components by means of the modulation and demodulation apparatus described in detail above. Some or all of the voice signal components may be shifted up in frequency, some or all may be shifted down in frequency, or some may be shifted up while others are shifted down and still others are not shifted at all. These shifts in frequency may change the frequency relationship between the voice signal components. Any combination of frequency shifts can be used to produce any desired voice modification.

Figure 3:
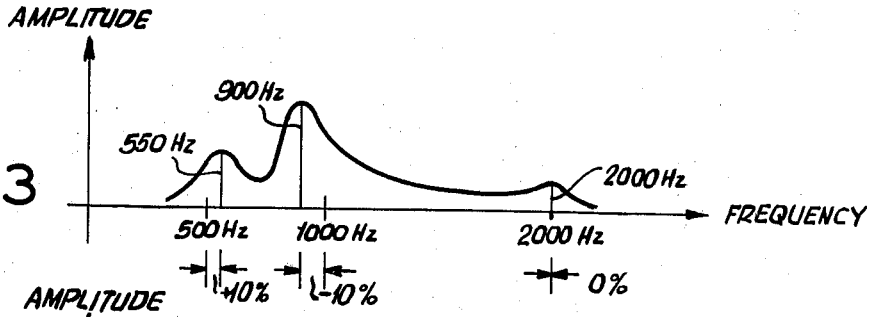
FIG. 3 is a diagram showing how the instantaneous voice signal frequency spectrum of FIG. 2 can be modified in accordance with the principles of the invention.

FIG. 3 illustrates one possible modification of the voice signal frequency spectrum of FIG. 2 in accordance with the invention. In FIG. 3 the modified low frequency voice signal component is 10% higher in frequency than the original low frequency voice signal component, the modified middle frequency component is 10% lower in frequency than the original middle frequency component, and the modified high frequency component is unchanged in frequency. Thus the frequency relationship between the several voice signal components has been changed significantly. Assuming the original voice sound was a normal voice sound, the result of modification of the type illustrated by FIG. 3 is typically an intelligible normal voice sound which does not sound like the voice of the speaker producing the original voice sound.

When a normal voice sound is applied to the apparatus to produce modified normal voice sounds (i.e., so-called normal voice in and modified normal voice out), the frequency shift of each voice signal component is preferably in the range from −30% to +30% of the original frequency of that voice signal component. These limits are especially applicable to the lower frequency components (i.e., below 3000 Hz) which are the primary constituents of the phoneme sounds required to form intelligible speech. If greater frequecy shifts are employed, the modified voice sounds no longer sound like normal voices. Such greater frequency shifts may be required, however, for such other applications of the apparatus as cartooning and similar special effects (normal voice sound in and abnormal but still intelligible voice sound out) and normalizing underwater diver speech sound (distorted voice sound in and more normal and intelligible voice sound out). In these applications requiring more extreme voice modification, the frequency shift of each voice signal component is typically in the range from −45% to +95% of the original frequency of that voice signal component.

Although there is no theoretical limitation on the minimum frequency shift for each voice signal component (and indeed some voice signal components may not be shifted at all), for practical purposes the minimum frequency shift for voice signal components which are shifted is the minimum frequency shift that is perceptible to the hearer of the modified voice sounds. This is typically a minimum frequency shift of at least about ±1%, preferably at least about +2%

Amplitude modifications using adjustable weighting networks, preferably postweighting networks 130, 132, 134, may additionally be employed if desired.

When the voice modification apparatus of this invention is used for modifying one speaker's voice to produce several different modified voice sounds, as is required, for example, for one speaker to play several different voice roles in a flight simulation, frequency selectors 100, 102, 104 may be controlled to select preset combinations of frequency generator output signals as demodulating signals so that the person conducting the flight simulation can easily switch from one voice role to another simply by pushing a button for the desired role.

Figure 8:
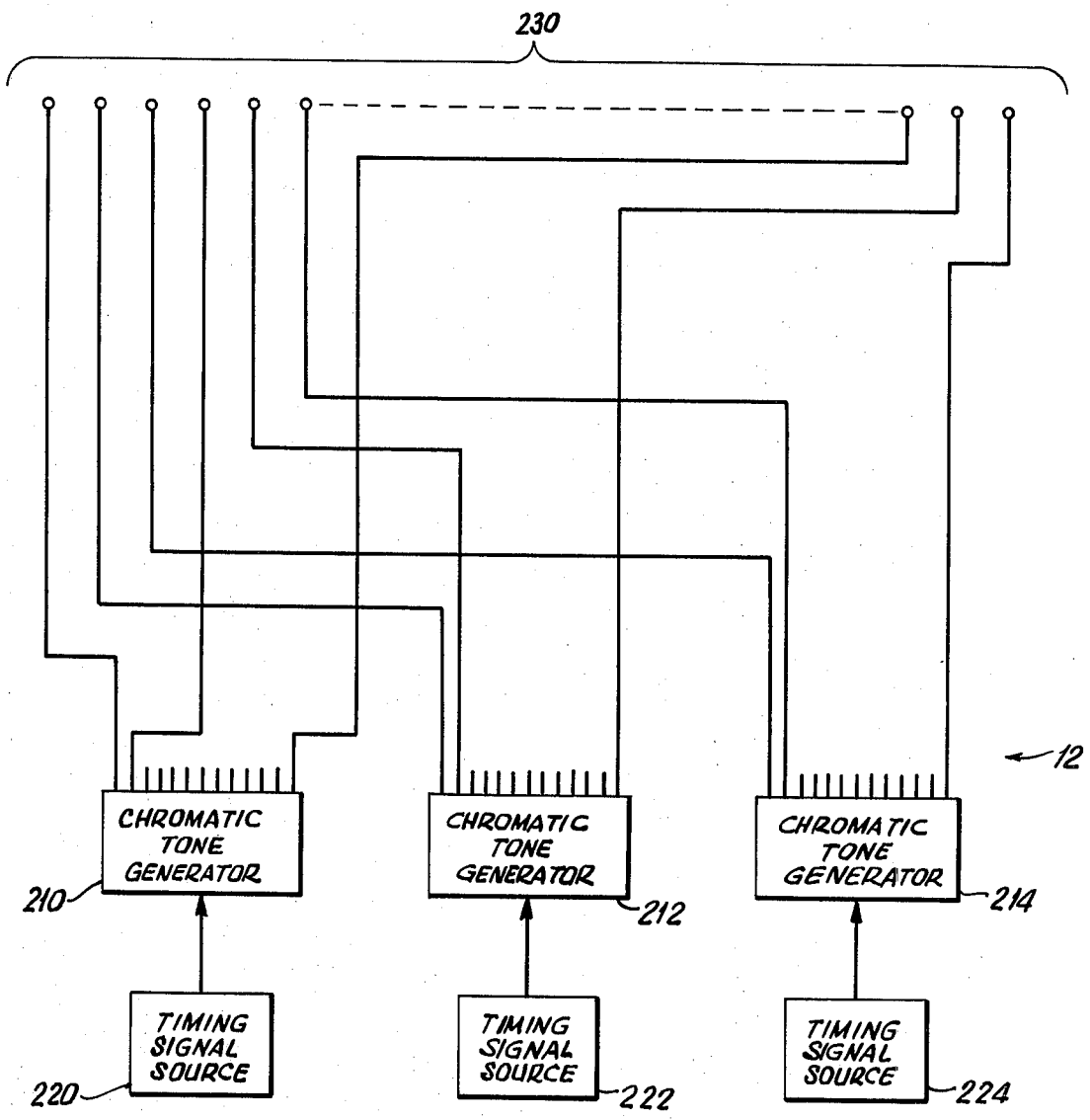
FIG. 8 is a block diagram of a preferred embodiment of a portion of the apparatus of FIG. 1.

A particularly preferred embodiment of frequency generator 12 is shown in greater detail in FIG. 8. This preferred frequency generator produces a large number of periodic output signals having closely spaced frequencies which are in a geometric sequence (i.e., the ratio between adjacent frequencies is the same for all frequencies). Moreover, this geometric sequence is related to the familiar chromatic tone sequence for musical instruments. In the chromatic tone sequence, the ratio between adjacent tones is $\sqrt[12]{2}=1.05946$. Frequency dividers for producing a plurality of chromatically related tones from a single clock signal are readily available and are used in musical instruments such as electronic organs.

The ratio between adjacent signal frequencies produced by the signal generator shown in FIG. 8 is $\sqrt[36]{2}=1.0194406$, i.e., each frequency is approximately 1.944% higher than the next lower frequency. The frequency steps in this sequence are approximately one third the magnitude of the frequency steps in the chromatic tone sequence and each step is close to the minimum perceptible frequency shift as mentioned above.

As shown in FIG. 8, the preferred frequency generator includes three identical chromatic tone generators 210, 212, 214. Each chromatic tone generator produces thirteen output signals having chromatically related frequencies. Chromatic tone generators 210, 212, 214 are respectively driven by timing signal sources 220, 222, 224. The frequencies of the timing signals produced by sources 220, 222, 224 are shifted relative to one another by the ratio $\sqrt[36]{2}=1.0194406$ so that the output signals of tone generators 210, 212, 214 can be interleaved to produce 39 output signals having frequencies related by the ratio $\sqrt[36]{2}=1.0194406$ as mentioned above. For example, the frequencies of the timing signals produced by sources 220, 222, 224 may be 2 MHz, 2.0389 MHz, and 2.0785 MHz, respectively. The lowest output signal frequency produced by each of chromatic tone generators 210, 212, 214 in response to these signals may be approximately 4184 Hz, 4265 Hz, and 4348 Hz, respectively. The remaining output signal frequencies are related to these frequencies by the ratio mentioned above.

The 39 output signals of chromatic tone generators 210, 212, 214 are applied to output terminals 230 of frequency generator 12 for use selectively as the basic reference and demodulating signals in the voice signal component processing channels of the apparatus. Preferably, the basic reference signal is one of the intermediate output signals of the tone generator so that there are both higher and lower signal frequencies available for use as demodulating signals.

As will be apparent from the foregoing description of the apparatus of the invention, the method of the invention includes separating voice sounds to be modified into a plurality of voice sound components each having a separate frequency band, shifting the frequency of at least one voice sound component, and recombining the voice sound components to produce the modified voice sounds. The various techniques and parameters discussed above in connection with the apparatus of the invention are also applicable to the method of the invention.

Although the invention has been described in detail with reference to a particular embodiment thereof, it will be understood that various modifications can be made by those skilled in the art without departing from the scope and spirit of the invention. For example, although three voice signal component processing channels are employed in the apparatus described above, in some applications only two channels might be required, while in other applications more than three channels might be desirable as discussed in detail above. Similarly, it is not necessary that the voice signal components in the several channels be octavely related as in the preferred embodiment. The several voice signal components may bear any desired frequency relationship to one another and separate frequency generators producing frequencies suitable for processing the signals in each channel can be provided if desired. Alternatively, even if the several voice signal components are not octavely related, a single frequency generator can be used to produce signals suitable for processing all of the voice signals with the same ease of control which is available in the preferred embodiment by dividing the frequency generator output signals used for processing each voice signal component by factors which are related to one another in inverse order to the frequency relationship between the voice signal components. For example, in the preferred embodiment, the voice signal components are octavely related by the factors 1, 2, 4 and the frequency division factors respectively used for those components are 4, 2, 1. If the voice signal components were related by the factors 1, 2, 3, frequency division factors of 3, 2, 1 could be respectively used for the output signals of a single frequency generator to provide the same type of system control available with the preferred embodiment.

What is claimed is:

1. Apparatus for modifying an applied voice signal to produce any one of a plurality of modified voice sounds, each of which has a unique understandable voice sound different from that which would result from the applied voice signal, comprising:

a plurality of band pass filters having mutually exclusive, collectively exhaustive, octavely related pass bands, each band pass filter being responsive to the applied voice signal for producing a respective one of a plurality of voice signal components having mutually exclusive, collectively exhaustive, octavely related frequency bands;

a frequency generator for producing a plurality of output signals having geometrically related frequencies all of which are higher than the highest frequency passed by the band pass filters, one of which is a basic reference frequency;

means responsive to the basic reference frequency output signal for producing a plurality of reference signals, each having frequency which is octavely related to the basic reference frequency;

a modulator associated with each of the band pass filters for modulating an applied respective one of the reference signals with the voice signal component produced by the associated band pass filter, the applied reference signal having frequency substantially higher than the associated frequency band, the voice signal component and the reference signal applied to each modulator having the same proportional frequency relationship;

a low pass filter associated with each of the modulators for substantially attenuating the upper sideband of the voice modulated signal component produced by that modulator;

a demodulator associated with each of the low pass filters for demodulating the filtered voice modulated signal component produced by the associated filter with an applied demodulating signal having frequency which is shifted relative to the associated reference signal frequency to produce a corresponding shift in the frequency of the associated voice signal component;

switching means associated with each of the demodulators for selecting any one of a plurality of the frequency generator output signals;

means responsive to the frequency generator output signal selected by each of the switching means for producing an output signal having the same octave frequency relationship to the associated switching means output signal as the associated reference frequency has to the basic reference frequency and for applying that output signal to the associated demodulator as the applied demodulating signal;

a low pass filter associated with each of the demodulators for substantially attenuating the components of the demodulator output signal having frequency higher than the base band component of the demodulator output signal;

a signal combining network for combining the demodulated voice signal components to produce a modified voice signal; and an audio transducer for rendering the modified voice signal audible.

2. The apparatus defined in claim 1 wherein the frequency of each voice signal component is shifted in the range from −30% to +30% of the original voice signal component frequency.

3. The apparatus defined in claim 1 wherein the pass band of each of the band pass filters includes the frequencies characteristic of a respective one of the formants of a majority of the phonemes in the applied voice signal.

4. The apparatus defined in claim 3 wherein there are three band pass filters having pass band center frequencies of 500, 1000, and 2000 Hz, respectively.

5. The apparatus defined in claim 4 wherein the pass bands of the three band pass filters are 350–650 Hz, 700–1300 Hz, and 1400–2600 Hz, respectively.

6. The apparatus defined in claim 1 wherein the frequency generator output signal frequencies are geometrically related by a ratio in the range from 1.01 to 1.02.

7. The apparatus defined in claim 6 wherein the frequency generator output signal frequencies are geometrically related by a ratio of about 1.01944.

8. The apparatus defined in claim 1 wherein the means for producing a plurality of reference signals comprises a plurality of frequency dividers for dividing the basic reference frequency in integer multiples of 2.

9. The apparatus claimed in claim 8 wherein the means responsive to the frequency generator output signal selected by each of the switching means comprises a frequency divider for dividing the frequency of the selected frequency generator output signal by the same number of integer multiples of 2 as the basic reference frequency is divided to produce the associated refrence frequency.

* * * * *